US011746581B2

(12) United States Patent
Krolewski et al.

(10) Patent No.: US 11,746,581 B2
(45) Date of Patent: Sep. 5, 2023

(54) FLIP HINGE

(71) Applicant: GM Global Technology Operations LLC, Detroit, MI (US)

(72) Inventors: Christine M Krolewski, Washington, MI (US); Joern Zirfass, Los Angeles, CA (US); Bob Thomas, Thousand Oaks, CA (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 106 days.

(21) Appl. No.: 17/493,119

(22) Filed: Oct. 4, 2021

(65) Prior Publication Data

US 2023/0104224 A1 Apr. 6, 2023

(51) Int. Cl.
*E05D 7/10* (2006.01)
*E05D 5/12* (2006.01)

(52) U.S. Cl.
CPC ..... *E05D 5/128* (2013.01); *E05D 7/1005* (2013.01); *E05Y 2900/531* (2013.01)

(58) Field of Classification Search
CPC .. E05D 7/10; E05D 7/12; E05D 7/121; E05D 7/125; E05D 7/126; E05D 7/1005; E05D 7/1016; E05D 7/1044; E05D 7/105; E05D 7/1022; E05D 7/1055; E05D 2007/1027; E05D 1/06; E05D 5/128; E05D 5/16; E05D 5/065; E05D 5/10; E05D 7/123; E05D 2007/126; H02B 1/38; H02B 1/44; H02B 1/46; Y10T 16/535; Y10T 16/536; Y10T 16/53605; Y10T 16/53607; Y10T 16/53613; Y10T 16/5361; Y10T 16/536075; Y10T 16/5478; Y10T 16/551; Y10T 16/547; Y10T 16/5474
See application file for complete search history.

(56) References Cited

U.S. PATENT DOCUMENTS 2,205,484 A * 6/1940 Lindsay ..... E05D 3/127 16/350
3,431,591 A * 3/1969 Betso ..... E05D 7/105 16/265

(Continued)

FOREIGN PATENT DOCUMENTS

DE 2854530 C3 4/1987
EP 1111176 A1 6/2001

(Continued)

*Primary Examiner* — Chuck Y Mah
(74) *Attorney, Agent, or Firm* — Vivacqua Crane PLLC

(57) ABSTRACT

A flip hinge for a motor vehicle includes an inner strap affixed to a body of the motor vehicle, an outer strap separate from the inner strap and affixed to a removable panel of the motor vehicle, and an intermediate link extending from the inner strap to the outer strap. The intermediate link is rotatably attached to the inner strap at a first link end by a spring-loaded pivot. The intermediate link is rotatably attached to the outer strap at a second link end by an outer strap pivot. The intermediate link is movable between at least a first position and a second position. The spring-loaded pivot biases the intermediate link towards the second position whenever the intermediate link is not in the first position, and the outer strap is separable from the intermediate link only when the intermediate link is in the first position.

20 Claims, 5 Drawing Sheets

(56) References Cited

U.S. PATENT DOCUMENTS

| | | | | | |
|---|---|---|---|---|---|
| 4,389,748 | A * | 6/1983 | Grossman | E05D 3/12 | 16/302 |
| 4,928,350 | A * | 5/1990 | Morgan | E05D 5/08 | 16/337 |
| 5,685,046 | A * | 11/1997 | Neag | E05D 3/127 | 16/334 |
| 5,915,441 | A * | 6/1999 | Schlack | E05D 3/12 | 16/334 |
| 5,937,480 | A * | 8/1999 | Kiefer | E05D 7/121 | 16/272 |
| 6,568,032 | B1 * | 5/2003 | Ramsauer | E05D 11/1078 | 16/329 |
| 2004/0055112 | A1 * | 3/2004 | Kiefer | E05D 11/06 | 16/302 |
| 2010/0213317 | A1 * | 8/2010 | Wagner | E05D 3/08 | 244/129.5 |
| 2013/0180177 | A1 * | 7/2013 | Lazarevich | E05F 1/1223 | 16/319 |
| 2020/0408014 | A1 * | 12/2020 | Morinaga | E05D 7/10 | |
| 2022/0243510 | A1 * | 8/2022 | Prison | E05D 5/128 | |

FOREIGN PATENT DOCUMENTS

| | | | | |
|---|---|---|---|---|
| GB | 2376982 | A * | 12/2002 | E05D 3/12 |
| JP | 2002332769 | A * | 11/2002 | |

* cited by examiner

FLIP HINGE

INTRODUCTION

The present disclosure relates to hinges for motor vehicles. More specifically, the present disclosure relates to hinges for vehicles having removable doors. Motor vehicles are often used in both on and off-road activities. Due to increasing interest in certain types of on and off-road activities, motorists appreciate the versatility of removing the doors to their motor vehicles. This allows the maximization of usable interior space, as well as the ability to simply ride or drive in an open vehicle. Motor vehicles with removable doors are typically equipped with a hinge mechanism, at least a portion of which is user-detachable to allow for the motor vehicle to be equipped with doors or for the doors to be removed by the user. While current removable door systems and hinges achieve their intended purpose, there is a need for a new and improved system and method for providing a straightforward, cost-effective, and easy-to-use removable door mechanism.

SUMMARY

According to several aspects of the present disclosure, a flip hinge for a motor vehicle includes an inner strap affixed to a body of the motor vehicle, an outer strap separate from the inner strap and affixed to a removable panel of the motor vehicle, and an intermediate link extending from the inner strap to the outer strap. The intermediate link is rotatably attached to the inner strap at a first link end by a spring-loaded pivot. The intermediate link is rotatably attached to the outer strap at a second link end by an outer strap pivot. The intermediate link is movable between at least a first position and a second position. The spring-loaded pivot biases the intermediate link towards the second position whenever the intermediate link is not in the first position, and the outer strap is separable from the intermediate link only when the intermediate link is in the first position.

In another aspect of the present disclosure, in the first position the intermediate link is disposed at an angle to the inner strap, and wherein in the second position the intermediate link is disposed substantially parallel to the inner strap and covers and optically obscures the inner strap.

In yet another aspect of the present disclosure, the flip hinge further includes a lift-off locking feature that defines a portion of the outer strap pivot. The lift-off locking feature includes a partial annular flange formed with and extending from the outer strap, and a slot formed through the intermediate link. The partial annular flange engages with the slot prevents axial movement of the removable panel along an axis of rotation of the outer strap pivot in a first panel position. The partial annular flange is interrupted in at least one circumferential location and defines a gap, wherein when the gap is aligned with the slot, axial movement of the outer strap relative to the intermediate link is possible.

In yet another aspect of the present disclosure the removable panel is selectively separable from the flip hinge such that when the intermediate link is in the first position, the outer strap is selectively separable from the intermediate link at the outer strap pivot. When the intermediate link is in the second position, the outer strap is prevented from engaging with the intermediate link at the outer strap pivot.

In yet another aspect of the present disclosure, when the intermediate link is in the first position, the removable panel of the motor vehicle is mountable to the intermediate link. When the intermediate link is in the second position, the removable panel of the motor vehicle is prevented from mounting to the intermediate link.

In yet another aspect of the present disclosure the spring-loaded pivot further includes a first pivot pin, a first pivot pin receiver formed through a first portion of the inner strap and a second pivot pin receiver formed through a second portion of the inner strap. The spring-loaded pivot further includes a first bushing, a spring, and a first pivot pin retainer. The first bushing is disposed overtop the spring, and the spring is disposed overtop the first pivot pin receiver. The first pivot pin extends through the first pivot pin receiver, the bushing, the spring, the first link end of the intermediate link, and into the second pivot pin receiver. The first pivot pin retainer engages with an end of the first pivot pin proximate the second pivot pin receiver and prevents the first pivot pin from withdrawing from the first and second pivot pin receivers of the inner strap.

In yet another aspect of the present disclosure the first link end further includes a top portion and a bottom portion different than and spaced apart from the top portion. The bottom portion defines one or more inverted curvilinear ramps and one or more first detent portions. The second pivot pin receiver defines one or more curvilinear ramps and one or more second detent portions. The one or more ramps and the one or more inverted ramps sized and shaped to slidably engage with one another. The one or more first and second detent portions are sized and shaped to lockingly engage with one another to prevent rotation of the intermediate link relative to the inner strap via the spring-loaded pivot.

In yet another aspect of the present disclosure the spring axially biases the one or more inverted curvilinear ramps against the one or more curvilinear ramps, thereby biasing the intermediate link towards the first position whenever the intermediate link is not in the second position.

In yet another aspect of the present disclosure the outer strap pivot further includes a first bore formed through the second link end, and a second bore formed through at least a portion of the outer strap. The outer strap pivot further includes a substantially cylindrical bushing disposed at least partially within one or more of the first bore and the second bore, and a second pivot pin. The outer strap pivot is assembled so that the second pivot pin extends through first bore, the second bore, and the substantially cylindrical bushing. The second pivot pin is secured within the second bore and fixed for common rotation with the outer strap.

In yet another aspect of the present disclosure the flip hinge further includes a rotation limiter. The rotation limiter defines an axially-extending flange portion of the outer strap at the outer strap pivot. The rotation limiter limits a rotation of the outer strap relative to the intermediate link to a predetermined range of rotational positions between about 0° and about 90°.

In yet another aspect of the present disclosure a flip hinge system for a motor vehicle includes a plurality of hinge elements, at least two of the plurality of hinge elements selectively separable from one another by a motor vehicle user. The plurality of hinge elements includes an inner strap affixed to a body of the motor vehicle, an outer strap separate from the inner strap and affixed to a removable panel of the motor vehicle, the removable panel being selectively separable from the flip hinge. The plurality of hinge elements further includes an intermediate link extending from the inner strap to the outer strap, a spring-loaded pivot rotatably attaching the intermediate link to the inner strap at a first link end, and an outer strap pivot rotatably attaching the intermediate link to the outer strap at a second link end distinct and separate from the first link end. The intermediate link is movable between at least a first position and a second position. In the first position the intermediate link is disposed at an angle to the inner strap, and in the second position the intermediate link is disposed substantially parallel to the inner strap and covers and optically obscures the inner strap. The spring-loaded pivot biases the intermediate link towards the second position whenever the intermediate link is not in the first position. The outer strap is separable from the intermediate link only when the intermediate link is in the first position.

In yet another aspect of the present disclosure further includes a lift-off locking feature that defines a portion of the outer strap pivot. The lift-off locking feature includes a partial annular flange formed with and extending from the outer strap, the partial annular flange having an interruption in at least one circumferential location. The lift-off locking feature further includes a rotation limiter defining an axially-extending flange portion of the outer strap at the outer strap pivot, and a slot formed through the intermediate link. The partial annular flange engages with the slot and to prevent axial movement of the removable panel along an axis of rotation of the outer strap pivot in a first panel position. The interruption in the partial annular flange combined with the rotation limiter defines a gap. When the gap is aligned with the slot the outer strap is axially movable relative to the intermediate link.

In yet another aspect of the present disclosure the rotation limiter limits a rotation of the outer strap relative to the intermediate link to a predetermined range of rotational positions between about 0° and about 90°.

In yet another aspect of the present disclosure when the intermediate link is in the first position, the outer strap is selectively separable from the intermediate link at the outer strap pivot. When the intermediate link is in the second position, the outer strap is prevented from engaging with the intermediate link at the outer strap pivot.

In yet another aspect of the present disclosure when the intermediate link is in the first position, the removable panel of the motor vehicle is mountable to the intermediate link. When the intermediate link is in the second position, the removable panel of the motor vehicle is prevented from mounting to the intermediate link.

In yet another aspect of the present disclosure the spring-loaded pivot further includes a first pivot pin, a first pivot pin receiver formed through a first portion of the inner strap and a second pivot pin receiver formed through a second portion of the inner strap. The spring-loaded pivot further includes a first bushing, a spring, and a first pivot pin retainer. The first bushing is disposed overtop the spring, and the spring is disposed overtop the first pivot pin receiver. The first pivot pin extends through the first pivot pin receiver, the bushing, the spring, the first link end of the intermediate link, and into the second pivot pin receiver. The first pivot pin retainer engages with an end of the first pivot pin proximate the second pivot pin receiver and prevents the first pivot pin from withdrawing from the first and second pivot pin receivers of the inner strap.

In yet another aspect of the present disclosure the first link end further includes a top portion and a bottom portion different than and spaced apart from the top portion. The bottom portion defines one or more inverted curvilinear ramps and one or more first detent portions. The second pivot pin receiver defines one or more curvilinear ramps and one or more second detent portions, the one or more curvilinear ramps and the one or more inverted curvilinear ramps sized and shaped to slidably engage with one another. The one or more first and second detent portions are sized and shaped to lockingly engage with one another to prevent rotation of the intermediate link relative to the inner strap via the spring-loaded pivot.

In yet another aspect of the present disclosure the spring axially biases the one or more inverted curvilinear ramps against the one or more curvilinear ramps, thereby biasing the intermediate link towards the first position whenever the intermediate link is not in the second position.

In yet another aspect of the present disclosure the outer strap pivot further includes a first bore formed through the second link end, a second bore formed through at least a portion of the outer strap, and a substantially cylindrical bushing disposed at least partially within one or more of the first bore and the second bore. The outer strap pivot further includes a second pivot pin, wherein the outer strap pivot is assembled so that the second pivot pin extends through first bore, the second bore, and the substantially cylindrical bushing, and wherein the second pivot pin is secured within the second bore and fixed for common rotation with the outer strap.

In yet another aspect of the present disclosure a flip hinge for a motor vehicle includes an inner strap affixed to a body of the motor vehicle, an outer strap separate from the inner strap and affixed to a removable panel of the motor vehicle, the removable panel is selectively separable from the flip hinge. The flip hinge further includes an intermediate link extending from the inner strap to the outer strap, and a spring-loaded pivot rotatably attaching the intermediate link to the inner strap at a first link end. The spring-loaded pivot further includes a first pivot pin, a first pivot pin receiver formed through a first portion of the inner strap and a second pivot pin receiver formed through a second portion of the inner strap. The spring-loaded pivot further includes a first bushing, a spring, and a first pivot pin retainer. The first bushing is disposed overtop the spring, and the spring is disposed overtop the first pivot pin receiver. The first pivot pin extends through the first pivot pin receiver, the bushing, the spring, the first link end of the intermediate link, and into the second pivot pin receiver. The first pivot pin retainer engages with an end of the first pivot pin proximate the second pivot pin receiver and prevents the first pivot pin from withdrawing from the first and second pivot pin receivers of the inner strap. The first link end further comprises a top portion and a bottom portion different than and spaced apart from the top portion. The bottom portion defines one or more inverted curvilinear ramps and one or more first detent portions, and the second pivot pin receiver defines one or more curvilinear ramps and one or more second detent portions. The one or more curvilinear ramps and the one or more inverted ramp are sized and shaped to slidably engage with one another, and the one or more first and second detent portions are sized and shaped to lockingly engage with one another to prevent rotation of the intermediate link relative to the inner strap via the spring-loaded pivot. The spring axially biases the one or more inverted curvilinear ramps against the one or more curvilinear ramps, thereby biasing the intermediate link towards the first position whenever the intermediate link is not in the second position. The flip hinge further includes an outer strap pivot rotatably attaching the intermediate link to the outer strap at a second link end, the second link end distinct and separate from the first link end. The outer strap pivot has a first bore formed through the second link end, a second bore formed through at least a portion of the outer strap, a substantially cylindrical bushing disposed at least partially within one or more of the first bore and the second bore, and a second pivot pin. The outer strap pivot is assembled so that the second pivot pin extends through first bore, the second bore, and the substantially cylindrical bushing. The second pivot pin is secured within the second bore and fixed for common rotation with the outer strap, and a lift-off locking feature that defines a portion of the outer strap pivot. The lift-off locking feature further includes a partial annular flange formed with and extending from the outer strap. The partial annular flange has an interruption in at least one circumferential location. The lift-off locking feature further includes a rotation limiter defining an axially-extending flange portion of the outer strap at the outer strap pivot, and a slot formed through the intermediate link. The partial annular flange engages with the slot and prevents axial movement of the removable panel along an axis of rotation of the outer strap pivot in a first panel position. The interruption in the partial annular flange combined with the rotation limiter defines a gap. When the gap is aligned with the slot the outer strap is axially movable relative to the intermediate link, and the intermediate link is movable between at least a first position and a second position. In the first position the intermediate link is disposed at an angle to the inner strap, and in the second position the intermediate link is disposed substantially parallel to the inner strap and covers and optically obscures the inner strap. When the intermediate link is in the first position, the outer strap is selectively separable from the intermediate link at the outer strap pivot. When the intermediate link is in the second position the outer strap is prevented from engaging with the intermediate link at the outer strap pivot and the removable panel is thereby prevented from mounting to the intermediate link.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
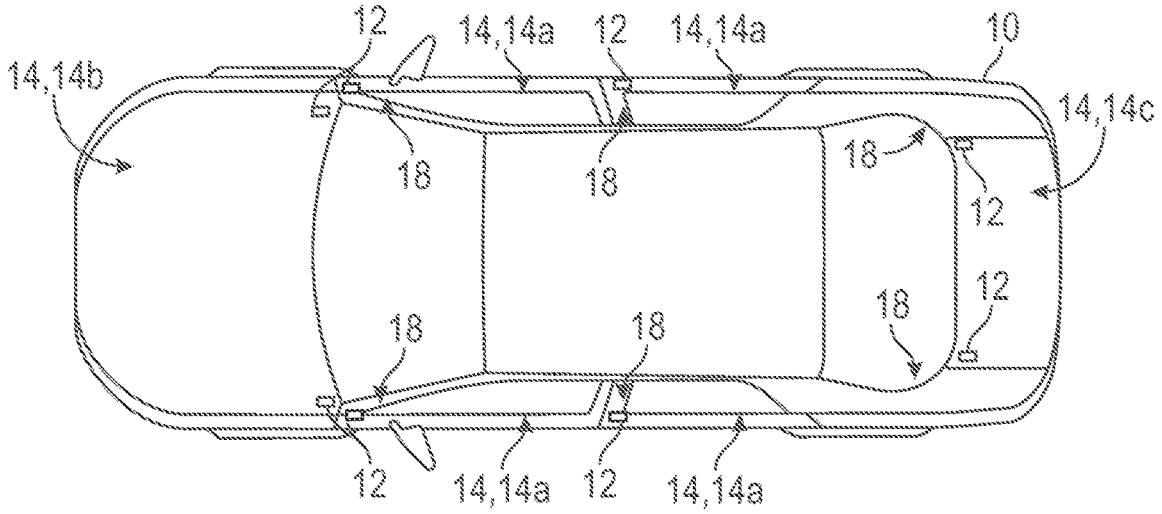
FIG. 1 is a plan view of a motor vehicle equipped with one or more flip hinges according to an aspect of the present disclosure.

Referring to FIG. 1, vehicle 10 having one or more flip hinges 12 for removable panels 14 is shown. The vehicle 10 shown is a car, however, it should be appreciated that the flip hinge 12 may be used in other types of vehicles 10 such as SUVs, trucks, semi trucks, tractor trailers, recreational vehicles, any of a variety of watercraft or aircraft, or the like without departing from the scope or intent of the present disclosure. In several aspects, the flip hinge 12 may be used in non-vehicular applications as well. The flip hinge 12 may be used in a variety of removable panel 14 applications as well. In several examples, the flip hinge 12 may be used with removable doors 14*a*, removable hoods 14*b*, removable trunks 14*c*, removable convertible tops (not specifically shown), removable lids for storage containers within a vehicle such as removable center console lids, removable truck bed box panels, removable trunk liner or truck bed panels, and the like.

Figure 2:
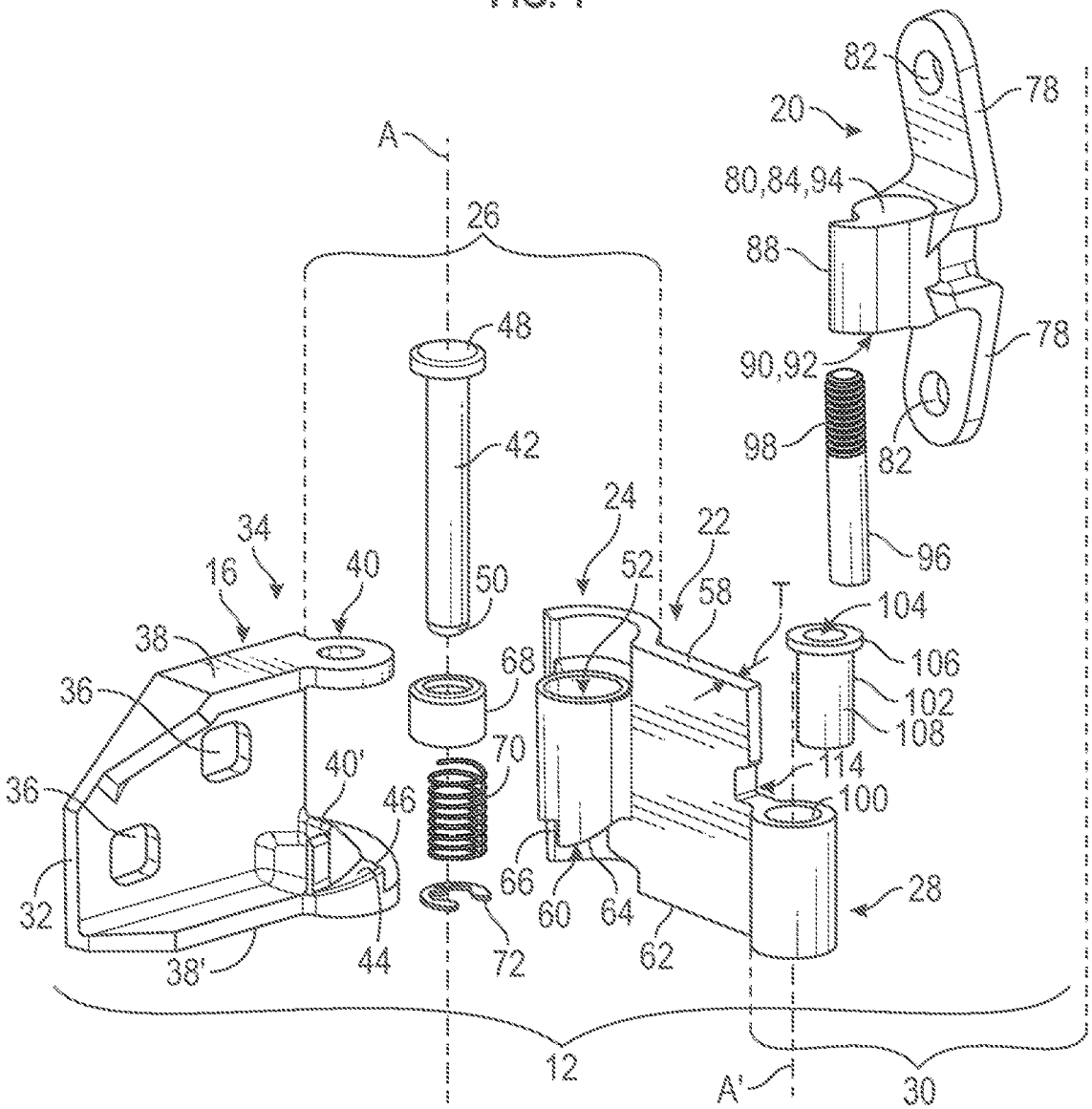
FIG. 2 is a perspective exploded view of a flip hinge according to an aspect of the present disclosure.
Figure 3:
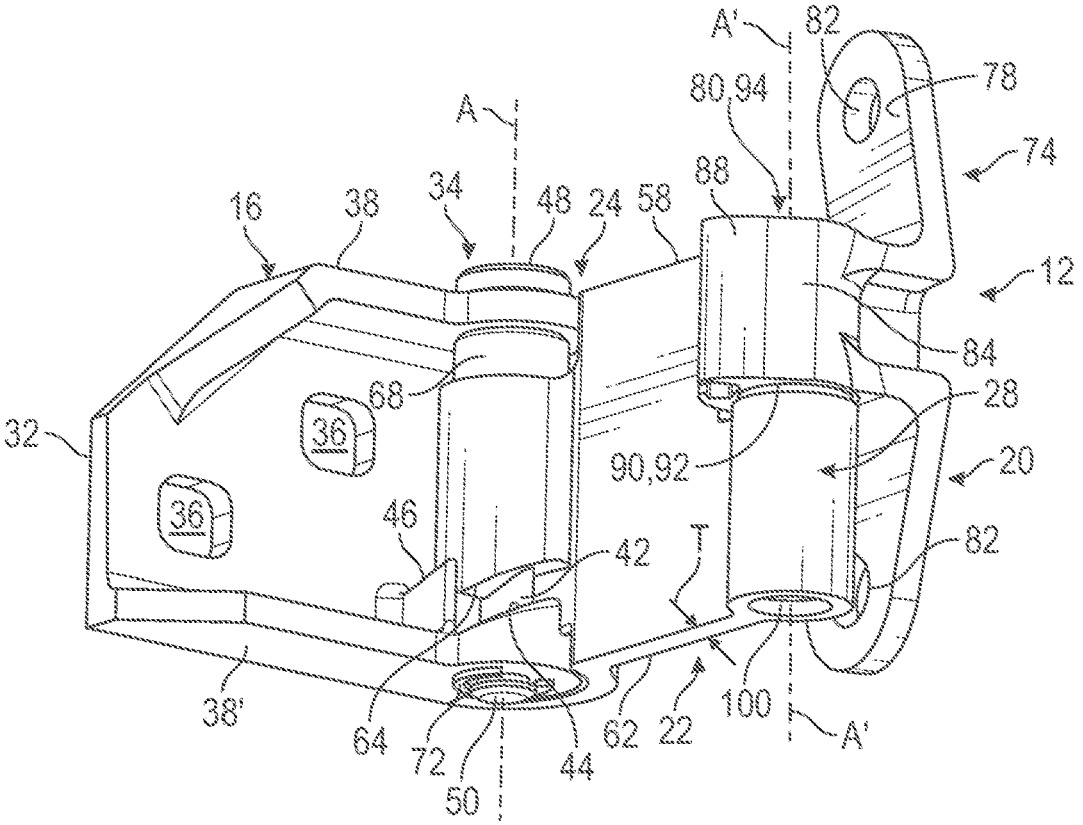
FIG. 3 is a perspective view of the flip hinge of FIG. 2 in a fully-assembled state according to an aspect of the present disclosure.
Figure 4:
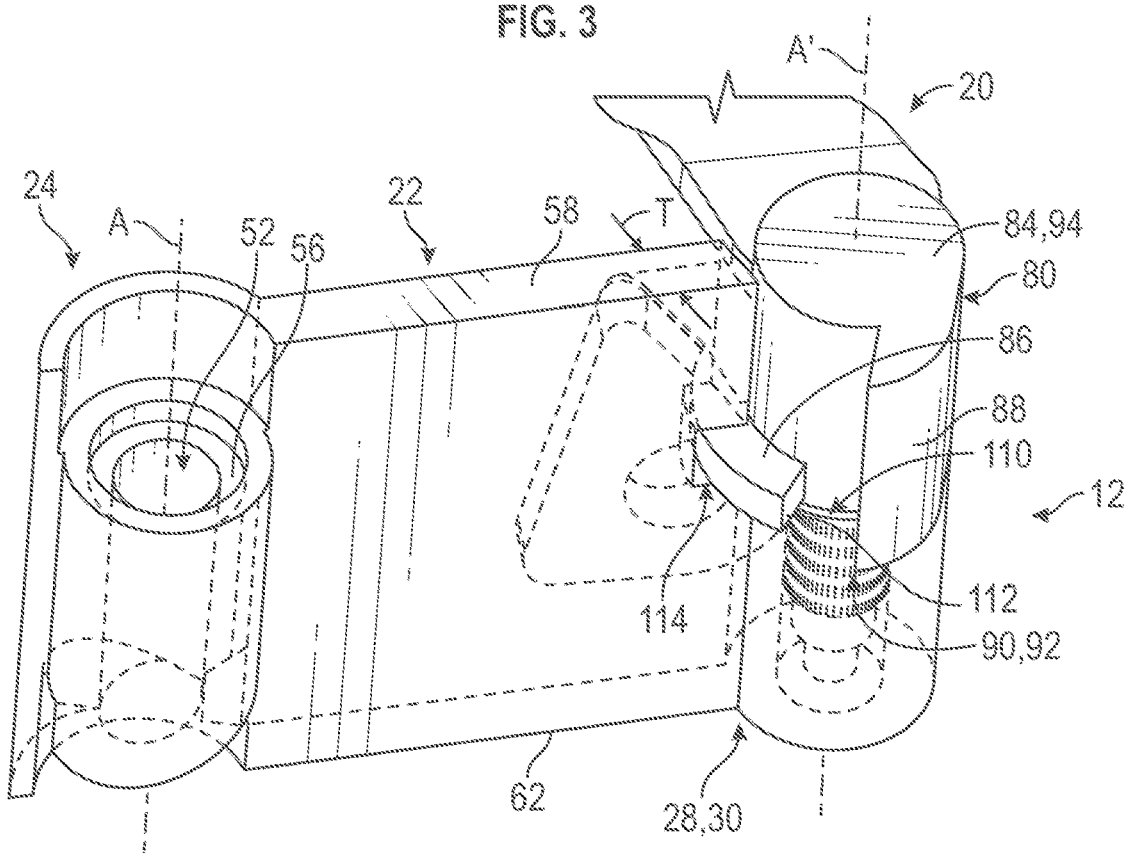
FIG. 4 is a perspective top view of a portion of the flip hinge of FIGS. 1-3 depicting an outer pivot according to an aspect of the present disclosure.

Referring now to FIGS. 2-4 and with continuing reference to FIG. 1 the flip hinge system or flip hinge 12 consists of a plurality of hinge elements, at least two of the plurality of hinge elements selectively separable from one another by a motor vehicle user. More specifically, the flip hinge 12 consists primarily of an inner strap 16 affixed to a body 18 of the vehicle 10, an outer strap 20 separate from the inner strap 16 and affixed to a removable panel 14 of the vehicle 10, and an intermediate link 22 extending from the inner strap 16 to the outer strap 20. Each of the inner strap 16, outer strap 20 and intermediate link 22 may be made of a variety of different materials including but not limited to: metals, metal alloys, molded and/or printed plastics, nylon materials, or the like. In several aspects, the inner strap 16, outer strap 20, and intermediate link 22 may be made of the same or similar materials, or may be made of materials distinct from one another, or any combination thereof.

The intermediate link 22 is rotatably attached to the inner strap 16 at a first link end 24 by a spring-loaded pivot 26. Similarly, the intermediate link 22 is rotatably attached to the outer strap at a second link end 28 by an outer strap pivot 30. The first and second link ends 24, 28 are spaced apart from one another, and axes A, A' of rotation of the spring-loaded pivot 26 and the outer strap pivot 30 are substantially parallel to one another.

The inner strap 16 may have a variety of different shapes and sizes depending on the particular application, but generally includes a substantially planar portion 32 and a hinge portion 34. The planar portion 32 includes one or more body attachment features 36. The body attachment features 36 may include apertures such as those shown in the figures, or studs, bolts, screws, rivets, or other such mechanical fasteners. The body attachment features 36 may also be chemical or thermal attachment features such as glues, epoxies, resins, or the like, or welded or braised connections, or the like.

The hinge portion 34 consists of one or more, and in one particular example at least two flanges 38, 38' parallel to and spaced apart from one another and substantially perpendicular to the planar portion 32. In several aspects, the at least two flanges 38, 38' serve multiple purposes including structural and functional functions. More specifically, a first pivot pin receiver 40 is formed through one of the flanges 38, and a second pivot pin receiver 40' is formed through the second of the flanges 38'. In several aspects, the first and second pivot pin receivers 40, 40' define substantially coaxial and substantially cylindrical apertures through the at least two flanges 38, 38'. The first and second pivot pin receivers 40, 40' are sized and shaped to accept and retain a first pivot pin 42 therein. In some examples, the first and second pivot pin receivers 40, 40' have identical diameters. In addition, the second pivot pin receiver 40' defines a curvilinear or helical ramp 44 and a first step or detent 46.

The first pivot pin 42 is a substantially cylindrical rod, tube, or similar structure having at least one portion with an increased diameter and forming a head 48. The head 48 of the first pivot pin 42 has a diameter larger than the diameter of any of the first and second pivot pin receivers 40, 40'. In some examples, the pivot pin 42 extends from the head 48 to a retaining portion 50 disposed opposite the head 48. The retaining portion 50 may take different forms depending on the particular application in which the flip hinge 12 is used. In several examples, the retaining portion 50 may be a retaining ring, a shoulder, a slot, or a bore that is orthogonal to the first axis of rotation A and where the bore, slot, or shoulder is formed through at least a portion of the first pivot pin 42. In several aspects, the first pivot pin 42 defines the first axis of rotation A along which the intermediate link 22 rotates relative to the inner strap 16.

A first pivot bore 52 is formed through the first link end 24. The first pivot bore 52 defines a portion of the spring-loaded pivot 26. The first pivot bore 52 is sized and shaped to receive the first pivot pin 42. In the figures, the first pivot bore 52 is shown in a vertical orientation such that a top 56 of the first pivot bore 52 is located proximate an upper edge 58 of the intermediate link 22. Likewise, a bottom 60 of the first pivot bore 52 is located proximate a lower edge 62 of the intermediate link 22. More specifically, the bottom 60 of the first pivot bore 52 defines one or more inverted curvilinear or helical ramps 64 and one or more inverted steps or detents 66.

The spring-loaded pivot 26 further includes a cylindrical bushing 68, a spring 70, and a first pivot pin retainer 72. The cylindrical bushing 68 and spring 70 are disposed adjacent to one another and between the first pivot pin receiver 40 and the top 56 of the first pivot bore 52. The spring 70 is shown as a helical spring, however, it should be appreciated that the spring 70 may be any of a variety of known spring types, including but not limited to helical springs, variable rate springs, constant rate springs, leaf springs, torsion springs, compression or tension springs, curved springs, wave springs, finger springs, or the like.

In several aspects, the cylindrical bushing 68 and spring 70 have a diameter larger than the first pivot bore 52 and larger than the first pivot pin receiver 40. Because the cylindrical bushing 68 and spring 70 have a larger diameter than at least a portion of the first pivot bore 52 and first pivot pin receiver 40, the cylindrical bushing 68 and spring 70 cannot pass through either the first pivot bore 52 or the first pivot pin receiver 40. In some examples, the spring 70 is disposed overtop the cylindrical bushing 68 which in turn is disposed overtop the top 56 of the first pivot bore 52. In other examples, the cylindrical bushing 68 is disposed overtop the spring 70 which in turn is disposed overtop the top 56 of the first pivot bore 52. The cylindrical bushing 68 may also have attachment features which locate and engage with the spring 70 so that the spring 70 and cylindrical bushing 68 are affixed to one another. While in the foregoing, the cylindrical bushing 68 and spring 70 have been described as having diameters larger than the first pivot bore 52 and first pivot pin receiver 40 variations which depart from these dimensions are intended to be within the scope of the instant disclosure. For example, the first pivot bore 52 may have an internally stepped diameter wherein at least a portion of the first pivot bore 52 has a diameter smaller than the diameters of the cylindrical bushing 68 and spring 70. Likewise, the cylindrical bushing 68 may have a stepped diameter such that at least a portion of the cylindrical bushing 68 can fit within but not pass entirely through the first pivot bore 52. Similarly, the spring 70 may have a diameter that is smaller than at least a portion of the first pivot bore 52. In examples, where the spring 70 diameter is smaller than a portion of the first pivot bore 52, the spring 70 may be at least partially retained within the first pivot bore 52, but cannot pass entirely through the first pivot bore 52. Accordingly, the spring 70 may be located within and/or affixed to a portion of the first pivot bore 52, allowing for simplified assembly of the spring-loaded pivot 26.

The spring-loaded pivot 26 is assembled so that the first pivot bore 52 is coaxially aligned with and located in-between the first and second pivot pin receivers 40, 40' of the inner strap 16, and so that the cylindrical bushing 68 and spring 70 are disposed between the top 56 of the first pivot bore 52 and the first pivot pin receiver 40. The first pivot pin 42 is inserted through the first pivot pin receiver 40, spring 70, cylindrical bushing 68, first pivot bore 52 and second pivot pin receivers 40' to form an axle about which the intermediate link 22 may rotate relative to the inner strap 16. The first pivot pin retainer 72 is inserted into the retaining portion 50 of the first pivot pin 42. In several aspects, the first pivot pin retainer 72 is an E-clip, C-clip, a contracting or expanding retainer, a circlip, a cotter pin, a spring pin, a retaining ring, a self-locking retaining ring, a rail clip, or any of a wide variety of similar devices. In further examples, the first pivot pin retainer 72 may be integral to the first pivot pin 42 itself. That is, the first pivot pin 42 may have an expandable portion optimized for insertion through each of the first and second pivot pin receivers 40, 40', the cylindrical bushing 68, spring 70, and the first pivot bore 52, but expandable so that once the expandable portion has emerged from the second pivot pin receiver 40', the expandable portion expands to a diameter larger than the second pivot pin receiver 40', thereby preventing retraction therefrom. In some examples, the expandable portion may be a spring-loaded expandable portion, a swiveling portion adapted to form a T-shaped structure, or the like. Accordingly, the head 48 of the first pivot pin 42 is disposed overtop the first pivot pin receiver 40, and the first pivot pin retainer 72 is disposed beneath the second pivot pin receiver 40'. The head 48 and first pivot pin retainer 72 operate to limit axial displacement of the first pivot pin 42 relative to all of the other components of the spring-loaded pivot 26 described above.

Figure 5:
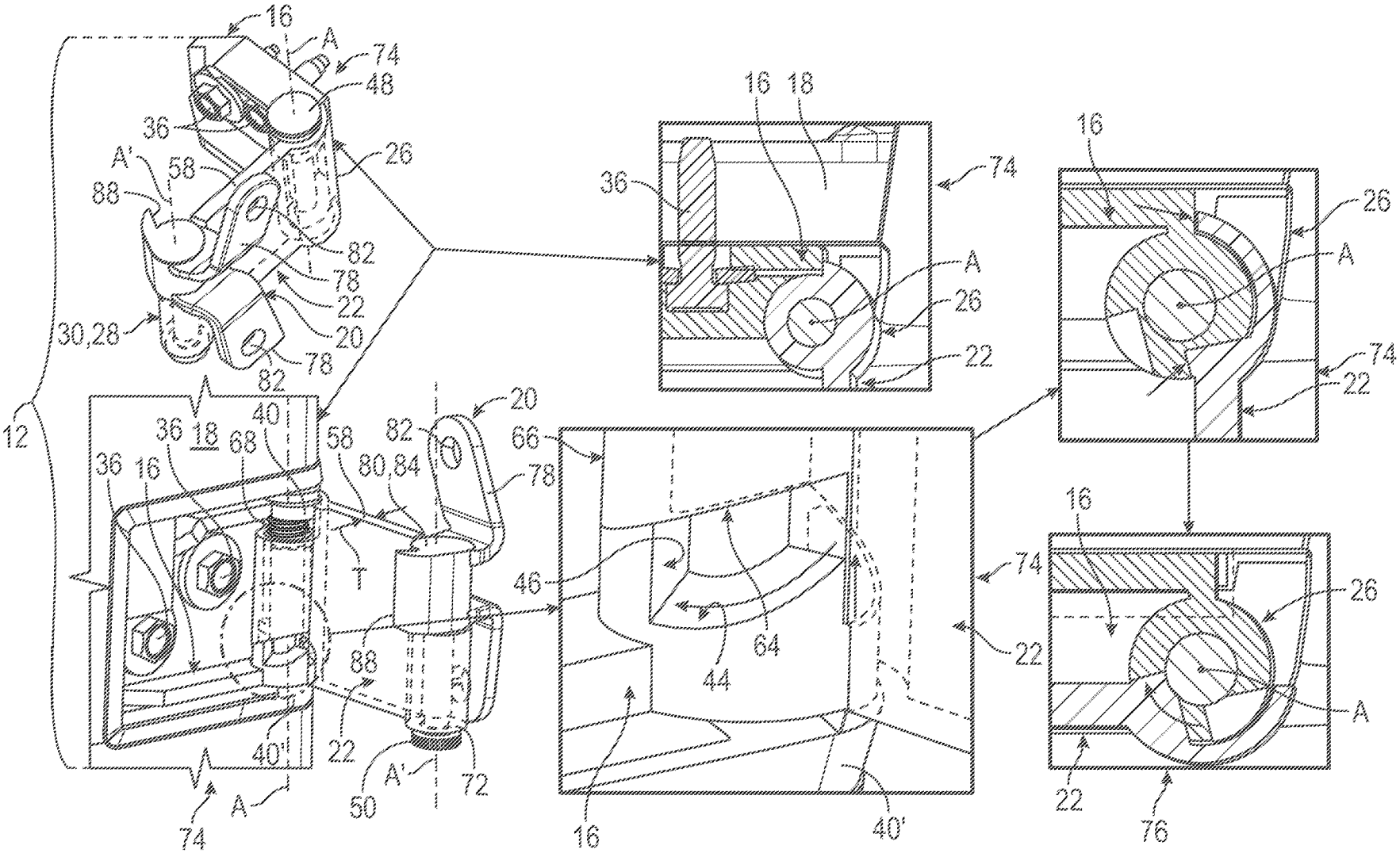
FIG. 5 is a series of perspective views depicting a progression of movement of a spring-loaded pivot of the flip hinge of FIGS. 1-4, according to an aspect of the present disclosure.

Referring now to FIG. 5, and with continuing reference to FIGS. 1-4, the one or more inverted helical ramps 64 are sized and shaped to selectively enter into sliding engagement with the one or more helical ramps 44, and the one or more inverted steps or detents 66 are sized and shaped to selectively enter into locking engagement with the one or more steps or detents 46. More broadly, the intermediate link 22 is rotatable between at least a link is movable between at least a first position 74 and a second position 76. In the first position 74 the intermediate link 22 is disposed at an angle to the inner strap 16, and the inverted step 66 of the intermediate link 22 is lockingly engaged with the step 46 of the inner strap 16. In some examples, in the first position 74, the intermediate link 22 is fixedly disposed at an angle between approximately 25° to 135°; 45° to 115°; 75° to 100°, or in some examples, at approximately 90° to the inner strap 16, however, other angles may be used depending on the particular vehicle 10 and the particular removable panel 14 application. In the second position 76, the intermediate link 22 is disposed substantially parallel to and substantially overlaps the inner strap 16, thereby covering and optically obscuring the inner strap 16. Furthermore, when the intermediate link 22 is at any rotational position between the first and second positions 74, 76, the spring 70 biases the intermediate link 22 so that the inverted ramp 64 is pushed into contact with the ramp 44. Furthermore, because the spring 70 biases the inverted ramp 64 into contact with the ramp 44, the slope of the ramp 44 causes the intermediate link 22 to move towards the second retaining portion 40', thereby causing the intermediate link 22 to automatically rotate towards and eventually halt in the second position 76.

While in the foregoing, the spring-loaded pivot 26 has been described as having a single ramp 44, a single inverted ramp 64, a single step or detent 46, and a single inverted step or detent 66, it should be appreciated that variations in quantities of each of these elements may vary, depending on the particular application. For example, the spring-loaded pivot 26 may have multiple ramps 44, inverted ramps 64, steps or detents 46 and inverted steps or detents 66 so that the intermediate link 22 may be locked into multiple different positions relative to the inner strap 16. For example, some vehicles 10 may be equipped, or selectively equipped with removable panels 14 such as removable doors 14*a* having shapes that may or may not fully span a body opening of the vehicle 10. Some vehicles 10 may be equipped with non-traditional doors 14*a* such as half-doors, tube-frame doors, or the like instead of traditional doors 14*a*. For non-traditional doors 14*a*, it may also be desirable to have a flip hinge 12 in which the intermediate link 22 may be positioned as previously described, and/or in rotational positions beyond those described hereinabove. For example, the intermediate link 22 may be positioned parallel to, adjacent to, and overlapping the inner strap 16 at a position we will refer to as 0°, and/or positioned parallel to but rotationally displaced from the inner strap 16 at a position that approaches 180°, or anywhere between 0° and 180°, depending on the requirements of a given vehicular application.

Referring now more specifically to the outer strap pivot 30, the outer strap 20 may have a variety of different shapes and sizes depending on the particular application, but generally includes a substantially planar section 78, and a hinge section 80. The planar section 78 includes one or more panel attachment features 82. The panel attachment features 82, like the body attachment features 36 may include apertures such as those shown in the figures, or studs, bolts, screws, rivets, or other such mechanical fasteners. The panel attachment features 82 may also be chemical or thermal attachment features such as glues, epoxies, resins, or the like, or welded or braised connections, or the like.

The hinge section 80 of the outer strap 20 defines a substantially cylindrical main body 84, a lift-off locking feature 86, and a rotation limiter 88. The rotation limiter 88 prevents over rotation of the outer strap 20 relative to the intermediate link 22. That is, the rotation limiter 88 allows rotation of the outer strap 20 relative to the intermediate link 22 within certain predetermined rotational positions. In one example, the rotation limiter allows approximately 90° of rotational freedom. The main body 84 defines a second pivot bore 90 extending from a lower surface 92 of the hinge section 80 towards the upper surface 94 of the hinge section 80. As shown in the figure, the second pivot bore 90 of some examples extends for a distance less than the full distance between the lower and upper surfaces 92, 94 of the hinge section 80. However, it should be appreciated that examples which depart from this sizing are intended to be included within the scope of the present application. For example, the second pivot bore 90 may be formed entirely through the hinge section 80 all the way through the lower and upper surfaces 92, 94 of the hinge section 80. The second pivot bore 90 is sized and shaped to accept and retain an outer strap pivot pin 96.

The outer strap pivot pin 96 of some examples may have structure substantially identical to that of the first pivot pin 42. In some examples, each of the first pivot pin 42 and the outer strap pivot pin 96 may be made of metals such as hardened steel, or the like. In other examples, such as those shown in the figures, the outer strap pivot pin 96 includes a threaded portion 98. The threaded portion 98 is sized and shaped to enter into threaded engagement with an internally threaded portion of the second pivot bore 90. Accordingly, when the threaded portion 98 is engaged within the internally threaded portion of the second pivot bore 90, the outer strap pivot pin 96 is fixed for common rotation with the second pivot bore 90, and thereby with the outer strap 20 as well. In other examples, the outer strap pivot pin 96 may be fixed to the outer strap 20 by other means such as chemical or thermal attachment means such as glues, epoxies, resins, or the like, or welded or braised connections. In still other examples, the outer strap pivot pin 96 may be formed unitarily with the outer strap 20. The outer strap pivot pin 96 defines the second axis of rotation A' and when the flip hinge 12 is fully assembled, the outer strap pivot pin 96 provides a means of rotation between the outer strap 20 and the intermediate link 22.

In order to provide the outer strap 20 a means of rotation relative to the intermediate link 22, the outer strap pivot pin 96 engages with an outer strap pivot pin receiver 100 located at the second link end 28 of the intermediate link 22. The outer strap pivot pin receiver 100 defines a bore extending through at least a portion of the intermediate link 22 at the second link end 28. An outer pivot bushing 102 is disposed within the outer strap pivot pin receiver 100 and defines a bushing bore 104 substantially coaxial and concentric with the bore of the outer strap pivot pin receiver 100. The outer pivot bushing 102, like the cylindrical bushing 68 of the spring-loaded pivot 26 may be composed of any of a variety of materials including plastic, nylon, metals, metal alloys, oil-impregnated metals such as oil-impregnated brass, Polytetrafluoroethylene (PTFE), or the like without departing from the scope or intent of the present disclosure. Moreover, the cylindrical bushing 68 and the outer pivot bushing 102 may be any of a wide variety of bushing or bearing types without departing from the scope or intent of the present disclosure. In several examples, the cylindrical bushing 68 and/or outer pivot bushing 102 may be bearing such as ball bearings, needle bearings, roller bearings, and/or bushings such those described above.

The outer pivot bushing 102 of some examples includes a flared portion 106 having a diameter larger than that of the outer strap pivot pin receiver 100, and a reduced portion 108 having a diameter smaller than the outer strap pivot pin receiver 100. Accordingly, the reduced portion 108 fits within the outer strap pivot pin receiver 100, and the flared portion 106 prevents the outer pivot bushing 102 from fully penetrating and/or slipping fully through the outer strap pivot pin receiver 100. The outer pivot bushing 102 provides for smooth, sliding, rotational movement of the outer strap pivot pin 96 relative to the intermediate link 22. In some aspects, the flared portion 106 also provides a contact surface in smooth, unobstructed, sliding contact with the hinge section 80 of the outer strap 20.

The lift-off locking feature 86 is a circumferentially-extending or partial annular flange formed unitarily with or otherwise attached to the cylindrical main body 84. In the examples shown in the figures, the lift-off locking feature 86 is located proximate the lower surface 92 of the hinge section 80, however the lift-off locking feature 86 may be located at other locations at along the cylindrical main body 84 without departing from the scope or intent of the present disclosure. The lift-off locking feature 86 is discontinuous about the circumference of the main body 84. That is the lift-off locking feature 86 defines a discontinuity, interruption or gap 110 formed through the circumferentially-extending partial annular flange of the lift-off-locking feature 86. The discontinuity or gap 110 extends from a terminal end 112 of the lift-off locking feature 86 to the rotation limiter 88. The discontinuity or gap 110 extends for a distance similar to, but slightly larger than a thickness "T" of the intermediate link 22. Accordingly, the discontinuity or gap 110 allows axial movement of the outer strap 20 relative to the intermediate strap 16 when the gap 110 is rotationally aligned with the intermediate strap 16.

The rotation limiter 88 extends axially for at least a portion of an axial height "H" of the outer strap 20, and forms a portion of the hinge section 80 of the outer strap 20. In several aspects, the rotation limiter 88 defines an axial flange extending radially outward from the cylindrical main body 84. In several aspects, the outer strap 20 is rotatable relative to the intermediate link 22 through a range of rotational positions delimited by the rotation limiter 88 at one extreme and by the substantially planar section 78 at a second extreme. When the intermediate strap 16 is in contact with the rotation limiter, the intermediate link 22 is located in the gap 110 of the lift-off locking feature 86 and the outer strap 20 may be moved axially relative to the intermediate link 22. In all other rotational positions, axial movement of the outer strap 20 is prevented by engagement of the lift-off locking feature 86 in a slot 114 formed through the intermediate link 22. The slot 114 is located proximate the outer strap pivot 30 and is sized and shaped to axially locate and slidingly accept the circumferentially-extending or partial annular flange of the lift-off locking feature 86.

Figure 6A:
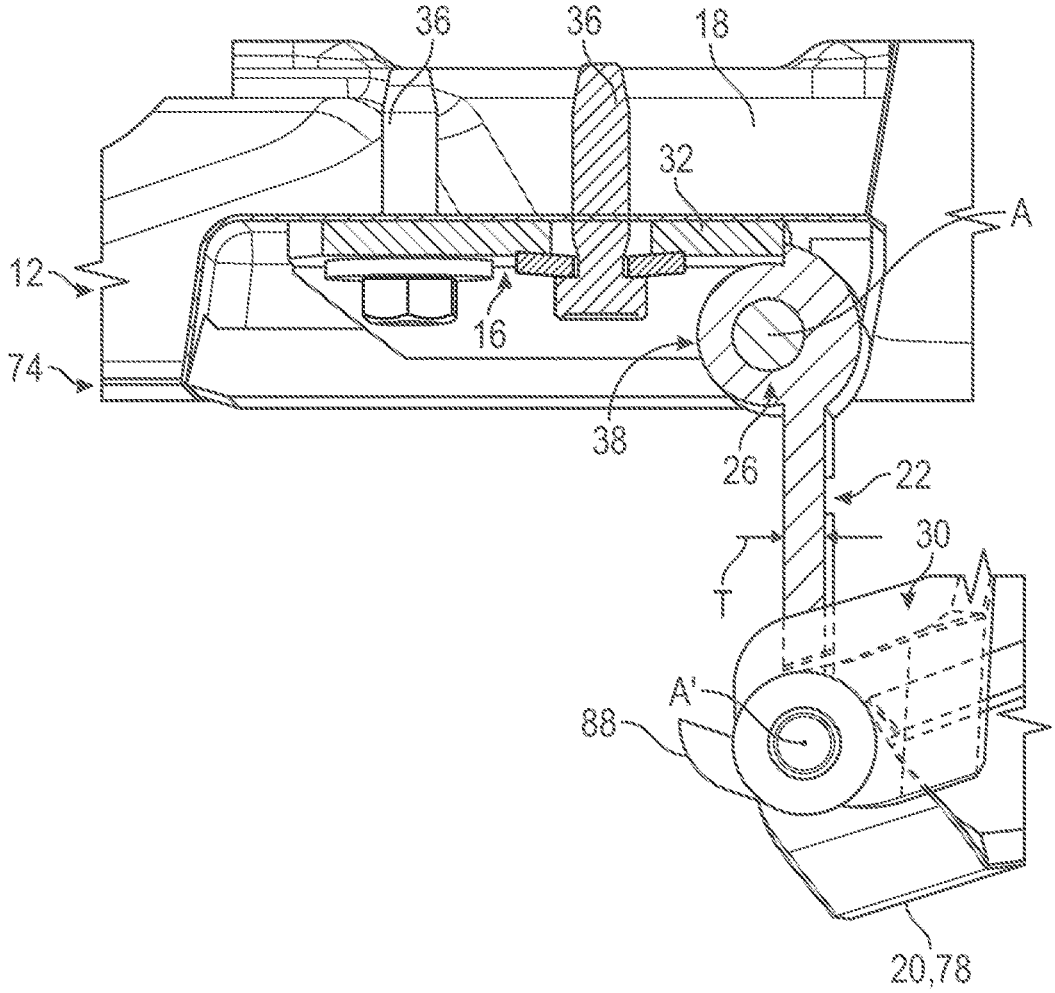
FIG. 6*a* is a perspective top partial section view of the flip hinge in a first, open, position according to an aspect of the present disclosure.
Figure 6B:
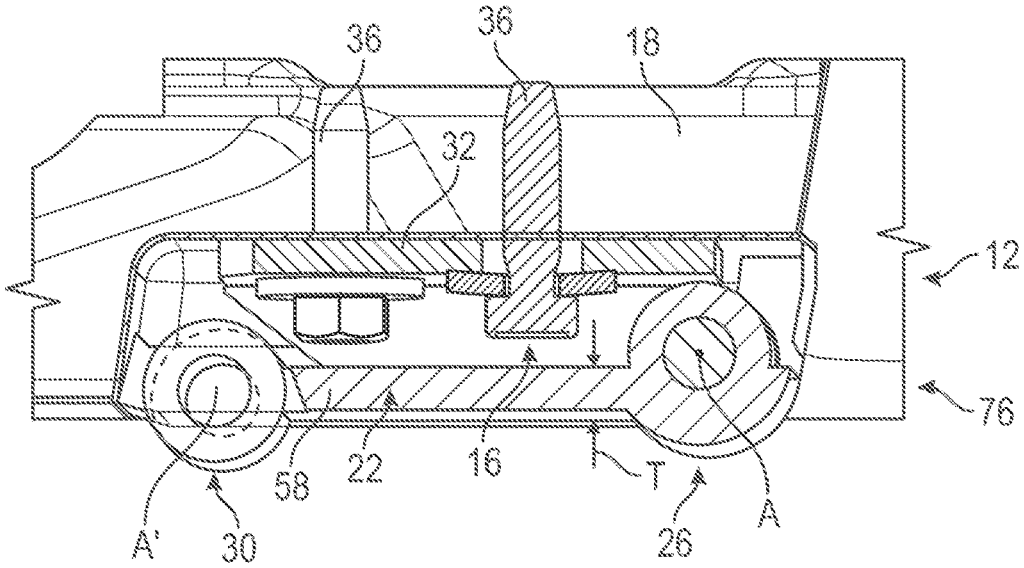
FIG. 6*b* is a perspective top partial section view of the flip hinge in a second, closed, position according to an aspect of the present disclosure.
Figure 7:
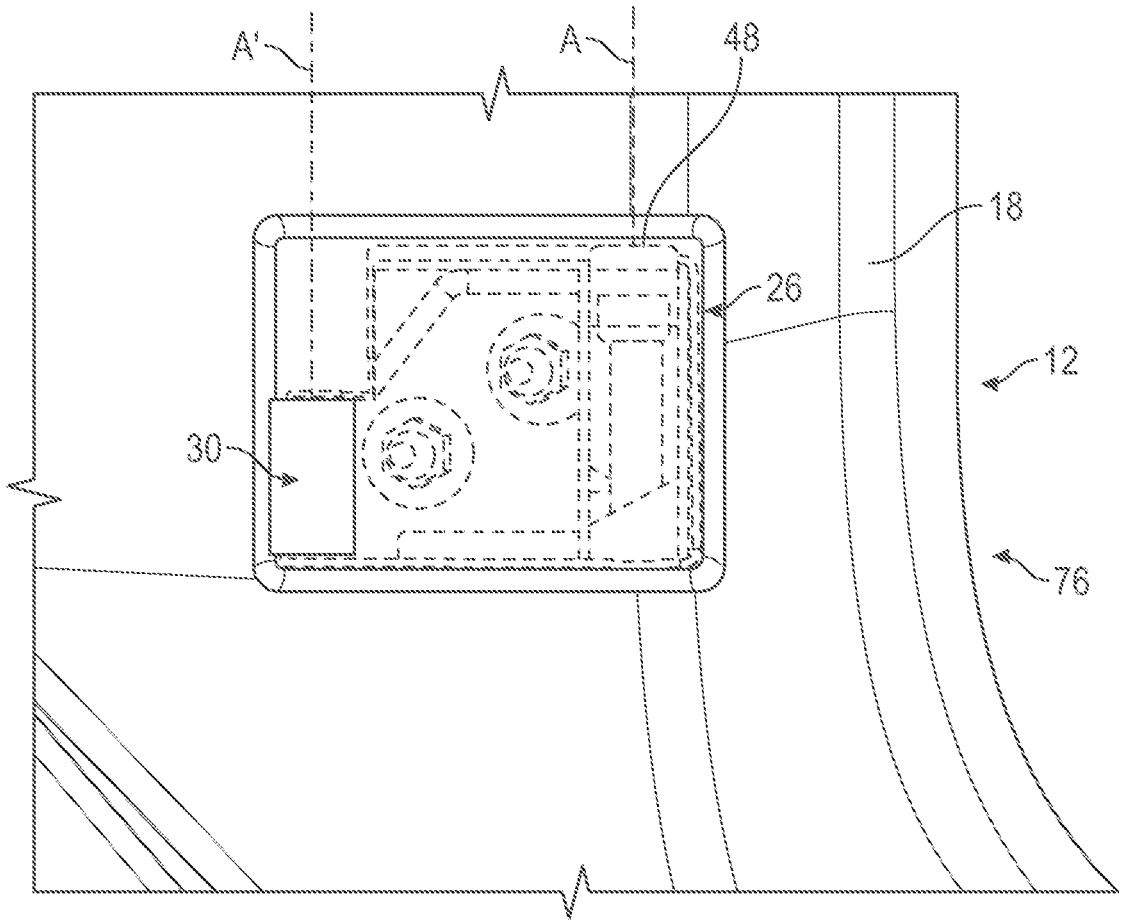
FIG. 7 is a perspective side view of the flip hinge of FIG. 6*b* in situ on a vehicle according to an aspect of the present disclosure.

Turning now to FIGS. 6*a*, 6*b*, and 7 and with continuing reference to FIGS. 1-5, the flip hinge 12 of the present disclosure provides an aesthetically appealing, and functional means by which a removable panel 14 may be selectively affixed to a vehicle 10. When the flip hinge 12 is in the second position 76, spring tension or bias from the spring 70 of the spring-loaded pivot 26 causes the intermediate link 22 to lie parallel to and substantially flat against the inner strap 16. More specifically, the spring 70 causes the inverted ramp 64 to be placed into contact with and into sliding engagement with the ramp 44. Due to spring bias and the slopes of the ramp 44 and inverted ramp 64, the intermediate link 22 moves towards the second retaining portion 40' and ultimately into the second position 76. However, while the spring 70 can exert sufficient force to ensure that the intermediate link 22 does not unintentionally move upwards (i.e. towards the first retaining portion 40), a person can overcome the spring force with relative ease and thereby manipulate the intermediate link 22 away from the second position 76. In several aspects, the spring force is between approximately 0 and 20 pounds of force, and preferably between approximately 5 and 10 pounds of force to allow a user to move the intermediate link 22 between the first and second positions 74, 76.

When the intermediate link 22 is rotated away from the second position 76, the intermediate link 22 rotates outwards and, at least momentarily, shifts upwards towards the first retaining portion 40. The shape of the ramp 44 and inverted ramp 64 in combination with the spring 70 provide resistance to rotational movement of the intermediate link 22 away from the second position 76. However, as the intermediate link 22 moves away from the second position 76 and towards the first position 74, the ramp 44 and inverted ramp 64 abruptly end at the step 46 and inverted step 66, respectively. The step 46 and inverted step 66 are substantially planar faces which are each substantially parallel to the first and second axes A, A'. Accordingly, as the ramp 44 and inverted ramp 64 slide against one another as the intermediate link 22 moves towards the first position 74, and the at the terminus of each of the ramp 44 and inverted ramp 64, the spring 70 causes the step 46 and inverted step 66 to lockingly engage with one another and to resist further rotation of the intermediate link 22 relative to the inner strap 16. Additionally, the spring 70 causes the intermediate link 22 to move axially downwards (i.e. towards the second retaining portion 40') in the first position 74. When the flip hinge 12 is in the first position 74, the intermediate link 22 is prevented from rotating about the first axis A by interaction of the step 46 and inverted step 66, while axial movement of the intermediate link 22 is resisted by the spring 70.

When the flip hinge 12 is in the second position 76 the outer strap 20 cannot be attached to the intermediate link 22. That is, because the intermediate link 22 is substantially flush against the inner strap 16 in the second position 76, the outer strap pivot pin receiver 100 is retracted against the inner strap 16 and access to the bore of outer strap pivot pin receiver 100 is restricted. Accordingly, when the flip hinge 12 is in the second position 76 a removable panel 14 cannot be attached to the flip hinge 12. By contrast, when the flip hinge 12 is in the first position 74, the outer strap pivot pin receiver 100 is exposed and the outer strap pivot pin 96 may be inserted therein for rotatably connecting the removable panel 14 to the flip hinge 12.

In some examples, the flip hinge 12 further includes a sliding and/or swinging lock feature. The sliding and/or swinging lock feature lockingly engages with the intermediate link 22 via the first pivot pin 42 to retain the intermediate link 22 in the first position 74. In some examples, the sliding and/or swinging lock feature is attached, formed with, or otherwise built into the inner strap 16, the intermediate link 22, or the outer strap 20, or any combination thereof. The sliding and/or swinging lock feature of some examples functions as a spacer sized to fit between the cylindrical bushing 68. The sliding and/or swinging lock feature may be a hinged apparatus having a spacer disposed at one end and a hinge at the other, or it may be a sliding portion of the inner strap 16, the intermediate link 22, the outer strap 20, or any combination thereof. The sliding and/or swinging lock feature is sized to axially space the cylindrical bushing 68 away from the first retaining portion 40, thereby preventing the bottom 60 of the first pivot bore 52 from rising sufficiently far to allow the step 46 from disengaging from the inverted step 66. Accordingly, the sliding and/or swinging lock feature, when engaged with the first pivot pin 42, prevents the intermediate link 22 from rotating from the first position 74 to any other position. The sliding and/or swinging lock feature is user engageable and user disengageable in some examples, while in others the sliding and/or swinging lock feature may be automatically engageable or disengageable. Because the sliding and/or swinging lock feature prevents movement of the intermediate link 22 away from the first position 74 when engaged, it also prevents accidental movement of the intermediate link 22 when a removable panel 14 is being attached or detached to the outer pivot 30.

While in the foregoing, the flip hinge 12 has been described as having a plurality of mechanical components, it should be appreciated that many vehicles 10 have removable panels 14 equipped with any of a wide variety of mechanical, electrical, hydraulic, and/or pneumatic devices. The flip hinge 12 of the present disclosure is not intended to interfere with such mechanical, electrical, hydraulic, and/or pneumatic devices or systems. In fact, in several examples, the mechanical, electrical, hydraulic, and/or pneumatic devices or systems may be coupled to the body 18 or other such structures of the vehicle 10 via couplings attached to, separable from or integrally formed with the inner strap 16, intermediate link, and outer strap 20, as well as, or including within the spring-loaded pivot 26 and the outer pivot 30. Likewise, such couplings may be separated from the mechanical features of the flip hinge 12 and supplied as one or more connectors within or otherwise attached to the body 18 and removable panel 14 of the vehicle 10.

In some examples, the flip hinge 12 is adapted to protect the body 18, removable panel 14, and the various components of the flip hinge 12 itself from water, dirt, road salt, and other potentially corrosive materials, and from the environment more generally. Specifically, the inner strap 16 and intermediate link 22 of some examples is equipped with an insulation material so that when the flip hinge 12 is in the first position 74, the inner strap 16 and intermediate link 22 are entered into waterproof sealing engagement with one another, thereby protecting the flip hinge 12 from the elements.

While in the foregoing, the flip hinge 12 has been described as having an inner strap 16, an intermediate link 22, and an outer strap 20, variations departing from these precise structures are intended to be within the scope of the present disclosure. In particular, in some vehicles 10, the intermediate link 22 may be exchanged for an intermediate link 22 having a somewhat different shape and/or structure by comparison with an original-equipment intermediate link 22. Such variations may allow for differently-shaped doors 14*a* or other removable panels 14 to be mounted to the vehicle 10. Additionally, while the flip hinge 12 has been described such that the inner strap 16 has first and second pivot pin receivers 40, 40' defining substantially coaxial and substantially cylindrical apertures through the at least two flanges 38, 38', and the intermediate link 22 has been described as having the first pivot bore 52 formed through the first link end 24, it should be appreciated that these features may be reversed in some applications. That is, the first and second pivot pin receivers 40, 40' and flanges 38, 38' may be formed as part of the intermediate link 22, rather than as part of the inner strap 16. In such examples, the inner strap 16 has the opposing structure as well, namely, the first pivot bore 52 is formed through a substantially cylindrical portion of the inner strap 16. Similarly, the structure of the outer strap pivot 30 may be reversed such that the features described hereinabove as being part of the intermediate link 22 are formed on the outer strap 20, and features described previously as being part of the outer strap 20 are instead formed as part of the intermediate link 22.

A flip hinge 12 of the present disclosure offers several advantages. These include both functional and aesthetic benefits. Specifically, the flip hinge 12 provides a means of covering removable panel 14 attachment features, including inner straps 16, and the like, while also allowing for simple, easily user-accessible means of panel 14 removal. Additionally, the flip hinge 12 of the present disclosure is built from components which are easily manufactured at low cost, has robust structural features, and prevents intrusion of precipitation and the like into the hinge itself.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A flip hinge for a motor vehicle, the flip hinge comprising:

an inner strap affixed to a body of the motor vehicle;

an outer strap separate from the inner strap and affixed to a removable panel of the motor vehicle; and an intermediate link extending from the inner strap to the outer strap, wherein the intermediate link is rotatably attached to the inner strap at a first link end by a spring-loaded pivot, and wherein the intermediate link is rotatably attached to the outer strap at a second link end by an outer strap pivot, wherein the intermediate link is movable between at least a first position and a second position, and the spring-loaded pivot biases the intermediate link towards the second position whenever the intermediate link is not in the first position, and the outer strap is separable from the intermediate link only when the intermediate link is in the first position.

2. The flip hinge of claim 1 wherein in the first position the intermediate link is disposed at an angle to the inner strap, and wherein in the second position the intermediate link is disposed substantially parallel to the inner strap and covers and optically obscures the inner strap.

3. The flip hinge of claim 2 further comprising a lift-off locking feature that defines a portion of the outer strap pivot, the lift-off locking feature comprising:

a partial annular flange formed with and extending from the outer strap; and a slot formed through the intermediate link, wherein the partial annular flange engages with the slot and to prevent axial movement of the removable panel along an axis of rotation of the outer strap pivot in a first panel position, and wherein the partial annular flange is interrupted in at least one circumferential location and defines a gap, wherein when the gap is aligned with the slot, axial movement of the outer strap relative to the intermediate link is possible.

4. The flip hinge of claim 3 wherein the removable panel is selectively separable from the flip hinge such that when the intermediate link is in the first position, the outer strap is selectively separable from the intermediate link at the outer strap pivot; when the outer strap is separated from the intermediate link and when the intermediate link is in the second position, the outer strap is prevented from mounting to the intermediate link at the outer strap pivot.

5. The flip hinge of claim 2 wherein when the intermediate link is in the first position, the removable panel of the motor vehicle is mountable to the intermediate link, and wherein when the removable panel is removed from the intermediate link and when the intermediate link is in the second position, the removable panel of the motor vehicle is prevented from mounting to the intermediate link.

6. The flip hinge of claim 5 wherein the first link end further comprises a top portion and a bottom portion different than and spaced apart from the top portion, wherein:

the bottom portion defines one or more inverted curvilinear ramps and one or more first detent portions; and the second pivot pin receiver defines one or more curvilinear ramps and one or more second detent portions, the one or more ramps and the one or more inverted ramps sized and shaped to slidably engage with one another, and wherein the one or more first and second detent portions are sized and shaped to lockingly engage in one or more rotational positions with one another to prevent rotation of the intermediate link relative to the inner strap via the spring-loaded pivot.

7. The flip hinge of claim 1 wherein the spring-loaded pivot further comprises:

a first pivot pin;

a first pivot pin receiver formed through a first portion of the inner strap and a second pivot pin receiver formed through a second portion of the inner strap;

a first bushing;

a spring; and a first pivot pin retainer, wherein the first bushing is disposed overtop the spring, and the spring is disposed overtop the first pivot bore of the first link end, wherein the first pivot pin extends through the first pivot pin receiver, the first pivot bore of the first link end, the bushing, the spring, the first link end of the intermediate link, and into the second pivot pin receiver, wherein the first pivot pin retainer engages with an end of the first pivot pin proximate the second pivot pin receiver and prevents the first pivot pin from withdrawing from the first and second pivot pin receivers of the inner strap.

8. The flip hinge of claim 7 wherein the spring axially biases the one or more inverted curvilinear ramps against the one or more curvilinear ramps, thereby biasing the intermediate link towards the first position whenever the intermediate link is not in the second position.

9. The flip hinge of claim 1 wherein the outer strap pivot further comprises:

a first bore formed through the second link end;

a second bore formed through at least a portion of the outer strap;

a substantially cylindrical bushing disposed at least partially within one or more of the first bore and the second bore; and a second pivot pin, wherein the outer strap pivot is assembled so that the second pivot pin extends through first bore, the second bore, and the substantially cylindrical bushing, and wherein the second pivot pin is secured within the second bore and fixed for common rotation with the outer strap.

10. The flip hinge of claim 1 further comprising a rotation limiter, wherein the rotation limiter defines an axially-extending flange portion of the outer strap at the outer strap pivot, and wherein the rotation limiter limits a rotation of the outer strap relative to the intermediate link to a predetermined range of rotational positions between about 0° and about 90°.

11. A flip hinge system for a motor vehicle, comprising:

a plurality of hinge elements, at least two of the plurality of hinge elements selectively separable from one another by a motor vehicle user, the plurality of hinge elements comprising:

an inner strap affixed to a body of the motor vehicle;

an outer strap separate from the inner strap and affixed to a removable panel of the motor vehicle, the removable panel being selectively separable from the flip hinge;

an intermediate link extending from the inner strap to the outer strap;

a spring-loaded pivot rotatably attaching the intermediate link to the inner strap at a first link end; and an outer strap pivot rotatably attaching the intermediate link to the outer strap at a second link end distinct and separate from the first link end, wherein the intermediate link is movable between at least a first position and a second position, wherein in the first position the intermediate link is disposed at an angle to the inner strap, and wherein in the second position the intermediate link is disposed substantially parallel to the inner strap and covers and optically obscures the inner strap, and the spring-loaded pivot biases the intermediate link towards the second position whenever the intermediate link is not in the first position, and the outer strap is separable from the intermediate link only when the intermediate link is in the first position.

12. The flip hinge system of claim 11 further comprising a lift-off locking feature that defines a portion of the outer strap pivot, the lift-off locking feature comprising:

a partial annular flange formed with and extending from the outer strap, the partial annular flange having an interruption in at least one circumferential location;

a rotation limiter defining an axially-extending flange portion of the outer strap at the outer strap pivot; and a slot formed through the intermediate link, wherein the partial annular flange engages with the slot and to prevent axial movement of the removable panel along an axis of rotation of the outer strap pivot in a first panel position, and wherein the interruption in the partial annular flange combined with the rotation limiter defines a gap, wherein when the gap is aligned with the slot the outer strap is axially movable relative to the intermediate link.

13. The flip hinge system of claim 12, and wherein the rotation limiter limits a rotation of the outer strap relative to the intermediate link to a predetermined range of rotational positions between about 0° and about 90°.

14. The flip hinge system of claim 12 wherein when the intermediate link is in the first position, the outer strap is selectively separable from the intermediate link at the outer strap pivot; when the outer strap is separated from the intermediate link, and when the intermediate link is in the second position, the outer strap is prevented from mounting to the intermediate link at the outer strap pivot.

15. The flip hinge system of claim 12 wherein when the intermediate link is in the first position, the removable panel of the motor vehicle is mountable to the intermediate link, and wherein when the removable panel is removed from the intermediate link and when the intermediate link is in the second position, the removable panel of the motor vehicle is prevented from mounting to the intermediate link.

16. The flip hinge system of claim 11 wherein the spring-loaded pivot further comprises:

a first pivot pin;

a first pivot pin receiver formed through a first portion of the inner strap and a second pivot pin receiver formed through a second portion of the inner strap;

a first bushing;

a spring; and a first pivot pin retainer, wherein the first bushing is disposed overtop the spring, and the spring is disposed overtop the first pivot bore of the first link end, wherein the first pivot pin extends through the first pivot pin receiver, the first pivot bore of the first link end, the bushing, the spring, the first link end of the intermediate link, and into the second pivot pin receiver, wherein the first pivot pin retainer engages with an end of the first pivot pin proximate the second pivot pin receiver and prevents the first pivot pin from withdrawing from the first and second pivot pin receivers of the inner strap.

17. The flip hinge system of claim 16 wherein the first link end further comprises a top portion and a bottom portion different than and spaced apart from the top portion, wherein:

the bottom portion defines one or more inverted curvilinear ramps and one or more first detent portions; and the second pivot pin receiver defines one or more curvilinear ramps and one or more second detent portions, the one or more curvilinear ramps and the one or more inverted curvilinear ramps sized and shaped to slidably engage with one another, and wherein the one or more first and second detent portions are sized and shaped to lockingly engage with one another to prevent rotation of the intermediate link relative to the inner strap via the spring-loaded pivot.

18. The flip hinge system of claim 16 wherein the spring axially biases the one or more inverted curvilinear ramps against the one or more curvilinear ramps, thereby biasing the intermediate link towards the first position whenever the intermediate link is not in the second position.

19. The flip hinge system of claim 11 wherein the outer strap pivot further comprises:

a first bore formed through the second link end;

a second bore formed through at least a portion of the outer strap;

a substantially cylindrical bushing disposed at least partially within one or more of the first bore and the second bore; and a second pivot pin, wherein the outer strap pivot is assembled so that the second pivot pin extends through first bore, the second bore, and the substantially cylindrical bushing, and wherein the second pivot pin is secured within the second bore and fixed for common rotation with the outer strap.

20. A flip hinge for a motor vehicle, the flip hinge comprising:

an inner strap affixed to a body of the motor vehicle;

an outer strap separate from the inner strap and affixed to a removable panel of the motor vehicle, the removable panel being selectively separable from the flip hinge;

an intermediate link extending from the inner strap to the outer strap;

a spring-loaded pivot rotatably attaching the intermediate link to the inner strap at a first link end, the spring-loaded pivot having:

a first pivot pin;

a first pivot pin receiver formed through a first portion of the inner strap and a second pivot pin receiver formed through a second portion of the inner strap;

a first bushing;

a spring; and a first pivot pin retainer, wherein the first bushing is disposed overtop the spring, and the spring is disposed overtop the first pivot bore of the first link end, wherein the first pivot pin extends through the first pivot pin receiver, the first pivot bore of the first link end, the bushing, the spring, the first link end of the intermediate link, and into the second pivot pin receiver, wherein the first pivot pin retainer engages with an end of the first pivot pin proximate the second pivot pin receiver and prevents the first pivot pin from withdrawing from the first and second pivot pin receivers of the inner strap, wherein the first link end further comprises a top portion and a bottom portion different than and spaced apart from the top portion, wherein:

the bottom portion defines one or more inverted curvilinear ramps and one or more first detent portions; and the second pivot pin receiver defines one or more curvilinear ramps and one or more second detent portions, the one or more curvilinear ramps and the one or more inverted curvilinear ramps sized and shaped to slidably engage with one another, and wherein the one or more first and second detent portions are sized and shaped to lockingly engage with one another to prevent rotation of the intermediate link relative to the inner strap via the spring-loaded pivot, wherein the spring axially biases the one or more inverted curvilinear ramps against the one or more curvilinear ramps, thereby biasing the intermediate link towards a first position whenever the intermediate link is not in a second position different from the first position, an outer strap pivot rotatably attaching the intermediate link to the outer strap at a second link end, the second link end distinct and separate from the first link end, the outer strap pivot having:

a first bore formed through the second link end;

a second bore formed through at least a portion of the outer strap;

a substantially cylindrical bushing disposed at least partially within one or more of the first bore and the second bore; and a second pivot pin, wherein the outer strap pivot is assembled so that the second pivot pin extends through first bore, the second bore, and the substantially cylindrical bushing, and wherein the second pivot pin is secured within the second bore and fixed for common rotation with the outer strap; and a lift-off locking feature that defines a portion of the outer strap pivot, the lift-off locking feature comprising:

a partial annular flange formed with and extending from the outer strap, the partial annular flange having an interruption in at least one circumferential location;

a rotation limiter defining an axially-extending flange portion of the outer strap at the outer strap pivot; and a slot formed through the intermediate link, wherein the partial annular flange engages with the slot and to prevent axial movement of the removable panel along an axis of rotation of the outer strap pivot in a first panel position, and wherein the interruption in the partial annular flange combined with the rotation limiter defines a gap, wherein when the gap is aligned with the slot the outer strap is axially movable relative to the intermediate link, and wherein the intermediate link is movable between at least the first position and the second position, wherein in the first position the intermediate link is disposed at an angle to the inner strap, and wherein in the second position the intermediate link is disposed substantially parallel to the inner strap and covers and optically obscures the inner strap, and wherein when the intermediate link is in the first position, the outer strap is selectively separable from the intermediate link at the outer strap pivot; when the outer strap is separated from the intermediate link and when the intermediate link is in the second position the outer strap is prevented from mounting to the intermediate link at the outer strap pivot and the removable panel is thereby prevented from mounting to the intermediate link.

* * * * *